US005698159A

United States Patent [19]

Ochi et al.

[11] Patent Number: 5,698,159

[45] Date of Patent: Dec. 16, 1997

[54] LONG-LIFE CARBURIZING BEARING STEEL

[75] Inventors: Tatsuro Ochi; Yuji Kawauchi, both of Muroran, Japan

[73] Assignee: Nippon Steel Corporation, Tokyo, Japan

[21] Appl. No.: 702,643

[22] PCT Filed: Jan. 18, 1996

[86] PCT No.: PCT/JP96/00074

§ 371 Date: Sep. 6, 1996

§ 102(e) Date: Sep. 6, 1996

[87] PCT Pub. No.: WO90/22404

PCT Pub. Date: Jul. 25, 1996

[30] Foreign Application Priority Data

Jan. 18, 1995 [JP] Japan ..... 7-022394

[51] Int. Cl.[6] ..... C22C 38/06; C22C 38/18

[52] U.S. Cl. ..... 420/104; 420/105; 420/109

[58] Field of Search ..... 420/105, 109, 420/104

[56] References Cited

U.S. PATENT DOCUMENTS

| | | | |
|---|---|---|---|
| 5,407,635 | 4/1995 | Iseda et al. | 420/109 |
| 5,518,685 | 5/1996 | Sakamoto et al. | 420/109 |

FOREIGN PATENT DOCUMENTS

| | | |
|---|---|---|
| 55-145158 | 11/1980 | Japan . |
| 1-129952 | 5/1989 | Japan . |
| 1-255651 | 10/1989 | Japan . |
| 3-100142 | 4/1991 | Japan . |
| 5-132713 | 5/1993 | Japan . |
| 5-140696 | 6/1993 | Japan . |
| 7-54103 | 2/1995 | Japan . |
| 6-134535 | 1/1996 | Japan . |

OTHER PUBLICATIONS

Bulletin of The Japan Institute of Metals (1993), vol. 32, No. 5, pp. 441–443.

*Primary Examiner*—Deborah Yee
*Attorney, Agent, or Firm*—Kenyon & Kenyon

[57] ABSTRACT

This invention aims at providing a carburizing bearing steel which can provide excellent rolling fatigue characteristics by providing a long life carburizing bearing steel comprising, in terms of percent by weight, 0.1 to 0.35% of C, 0.3 to 2.0% of Mn, 0.001 to 0.03% of S, 0.4 to 1.5% of Cr, 0.01 to 0.07% of Al, 0.003 to 0.015% of N, 0.0005 to 0.03% of T.Mg, "0.35 to 1.70% of Si" or "0.05 to 1.70% of Si and 0.30 to 1.20% of Mo", a specific amount of at least one member consisting of Ni and V, and not more than 0.025% of P, and not more than 0.0050% of Ti and not more than 0.0020% of T.O, wherein a number ratio of Mg type oxides contained in the steel is at least 0.8.

8 Claims, No Drawings

LONG-LIFE CARBURIZING BEARING STEEL

FIELD OF THE INVENTION

This invention relates to a long-life carburizing bearing steel. Specifically, the present invention relates to a steel which is produced by a step of carburizing-quenching process, and which is suitably used for bearing parts such as outer rings, inner rings, rollers, etc., applied to a condition under high load.

BACKGROUND ART

An improvement in rolling fatigue life of bearing parts has also been strongly required due to the higher power of automobile engines and the severer environmental regulations, enacted in recent years. To cope with these demands, longer service life has been accomplished by increasing the cleanness of steel because it was believed that rolling fatigue failure of the bearing parts occurs from non-metallic inclusions as starting points. For example, the Japan Institute of Metals, Vol. 32, No. 6, pp. 411–443 reports that oxide type inclusions can be reduced by the combination of a tapping technique of an eccentric furnace bottom, an RH vacuum degassing method, etc., and thus the rolling fatigue life can be improved. However, the longer life of this material is not always sufficient, and specifically when the bearing is applied under a high load condition, the development of a steel having an even longer service life is required.

As a steel kind in this field, SUJ 2 (according to JIS), for example, has been commonly used as a steel which has improved in rolling fatigue life. For improvement of the cuttability of this bearing steel, Japanese Unexamined Patent Publication (Kokai) No. 55-145158 discloses a Te-containing bearing steel and Japanese Unexamined Paten Publication (Kokai) No. 1-255651 discloses a bearing steel to which REM is added. However, a strong demand for a longer life of these steels, under a high load condition, still exists.

In contrast, the inventor of the present invention proposed, in Japanese Patent Application No. 6-134535, a high carbon chromium type bearing steel containing suitable amounts of Mg and Mo. Excellent rolling fatigue characteristics can be obtained by using this steel. However, there is a problem in that the high carbon chromium type bearing steel requires a long annealing step, for refining coarse carbides, because the coarse carbides deteriorate the fatigue life, since C and Cr contents are high and large eutectic carbides are formed in the bearing steel. Specifically, in the high carbon chromium type bearing steel the fatigue life in use under a high load is not necessarily sufficient.

DISCLOSURE OF INVENTION

It is an object of the present invention to provide a carburizing bearing steel which can exhibit excellent rolling fatigue characteristics in bearing parts. The present invention solves the problems in the above prior arts.

The invention of each of claims 1 to 4 provides a long-life carburizing bearing steel which comprises, in terms of weight: 0.10 to 0.35% of C, 0.3 to 2.0% of Mn, 0.001 to 0.03% of S, 0.4 to 1.50% of Cr, 0.010 to 0.07% of Al, 0.003 to 0.015% of N, 0.0005 to 0.0300% of total Mg; and further 0.35 to 1.70% of Si, or 0.05 to 1.70% of Si and 0.30 to 1.20% of Mo; or further, one or at least two elements selected from the group consisting of the following elements in the following amounts; 0.10 to 2.00% of Ni, 0.03 to 0.7% of V; and further, no more than 0.025% of P, not more than 0.0050% of Ti, not more than 0.0020% of total 0, and the balance consisting of iron and unavoidable impurities.

In the inventions as set forth in claims 1 to 4, the invention of claim 5 relates to the long-life carburizing bearing steel wherein oxides contained in the steel satisfy the following formula in terms of a number ratio:

(number of $MgO \bullet Al_2O_3$+number of MgO)/number of total oxide type inclusions$\geqq$0.80.

BEST MODE FOR CARRYING OUT THE INVENTION

The present invention pays specific attention to a carburizing step of a medium carbon steel to realize a production process for bearing parts in which formation of eutectic carbides cannot occur, that is, a long annealing time is not necessary in the process, and the fatigue life is not deteriorated due to coarse carbides, and specifically to realize a long life even in use under a high load. The above object has been accomplished by the present invention.

When the present invention having the above scope of claims for patent is specified, in order to attain excellent rolling fatigue characteristics of bearing parts, the inventors of the present invention have paid specific attention to a carburizing step of a medium carbon steel which will replace the hardening and tempering step of the conventional high carbon chromium type bearing steel. Because great compression residual stress occurs in the surface layer of the carburizing-quenching material, longer service life can be effectively obtained. To accomplish a carburizing bearing steel capable of obtaining excellent rolling fatigue characteristics even under a high load, the present inventors have furthered their studies and have made the following observations.

(1) In rolling fatigue failure under a high load condition, a rolling fatigue failure starts from a nonmetallic inclusion accompanying a white structure with a carbide structure on the periphery thereof. The white structure and the carbide structure involve hardness lowering. The formation of the white structure and the carbide structure is inhibited by making the nonmetallic inclusions fine.

(2) As described above, making nonmetallic inclusions fine is effective in extending the life of the steel. (Making nonmetallic inclusions fine has the following two advantages: (i) reduction of stress concentration which has heretofore been believed to cause crack formation, and (ii) inhibition of the formation of the white structure and the carbide structure which have been newly found.) Moreover, it becomes important to inhibit the formation of the white structures and the carbide structures on the periphery of nonmetallic inclusions in the process of rolling fatigue and prevent hardness lowering thereon.

(3) In order to make the nonmetallic inclusions fine, the addition of Mg in a proper amount, as proposed in Japanese Unexamined Patent Publication (Kokai) No. 7-54103 by the present inventors, is effective. The fundamental concept of this method is as follows: Mg is added to a practical carbon steel containing Al, and the oxide composition is converted from $Al_2O_3$ to $MgO \bullet Al_2O_3$ or MgO; as a result the oxide aggregates are prevented, and the oxide is dispersed in a fine form. Since $MgO \bullet Al_2O_3$ or MgO has a low surface energy when in contact with molten steel, as compared with $Al_2O_3$, the nonmetallic inclusions do not easily become aggregates, and a fine dispersion thereof is achieved. As described above, making the nonmetallic inclusions fine has two advantages, namely the reduction of stress concentration causing crack formation, and the inhibition of the formation of the white structure and the carbide structure. The addition of Mg is, therefore, greatly effective in extending the life of the bearings made of the steel.

(4) Next, in order to inhibit the formation of the white structure and the carbide structure and to prevent a reduction in hardness, an increase in the Si convent is effective, and the addition of Mo is also effective.

(5) In addition to the effects described above, the effects of inhibiting the formation of the white structure and the carbide structure and preventing hardness reduction become greater by adding further Ni and V.

The present invention has been completed on the basis of the novel finding described above. The reasons for restricting the range of the chemical of composition of the steel of the present invention are explained below.

C: 0.1 to 0.35%

Carbon is an effective element for increasing hardness of a core portion in carburizing bearing parts. The strength is not sufficient when its content is less than 0.10%, and when the content exceeds 0.35%, toughness is deteriorated and a compression residual stress effective on fatigue strength of case hardening parts hardly occurs. Therefore, the C content is defined to be from 0.10 to 0.35%.

Mn: 0.3 to 2.0%

Cr: 0.4 to 1.50%

Manganese and chromium are effective elements for improving the hardenability and increasing the retained austenite after carburizing step. However, when these are less than 0.30% of Mn and less than 0.4% of Cr these effects are not sufficient and if these amounts exceed 2.0% of Mn and 1.5% of Cr the effects are saturated and an amount of adding these elements is costly and undesirable. Therefore, the Mn content is limited to 0.30 to 2.0% and the Cr content to 0.4 to 1.5%.

S: 0.001 to 0.03

Sulfur is present in the steel as MnS, and contributes to improve the machinability thereof and make the structure fine. However, when the S content is less than 0.001%, the effects are insufficient. On the other hand, the effects are saturated, and the rolling fatigue characteristics are rather deteriorated, when the S content exceeds 0.03%. For the reason as described above, the S content is defined to be from 0.001 to 0.03%.

Aluminum is added as an element for deoxidation and grain refining but the effects become insufficient when the Al content is less than 0.010%. On the other hand, the effects are saturated, and the toughness is rather deteriorated when the Al content exceeds 0.07%. Accordingly, the Al content is defined to be from 0.010 to 0.07%.

N: 0.003 to 0.015

Nitrogen contributes to make austenite grains fine through the precipitation behavior of AlN. However, the effects become insufficient when the N content is less than 0.003%. On the other hand, the effects are saturated, and the toughness is rather deteriorated, when the N content exceeds 0.015%. Accordingly, the N content is defined to be from 0.003 to 0.015%.

Total Mg: 0.0005 to 0.0300%

Magnesium is a strong deoxidizing element and reacts with $Al_2O_3$ in the steel. It is added in order to deprive $Al_2O_3$ of O and to form $MgO \bullet Al_2O_3$ or MgO. Therefore, unless at least a predetermined amount of Mg is added in accordance with the $Al_2O_3$ amount, that is, in accordance with T.O wt %, unreacted $Al_2O_3$ undesirably remains. As a result of a series of experiments in this connection, it has been found out that remainder of unreacted $Al_2O_3$ can be avoided and the oxides can be completely converted to $MgO \bullet Al_2O_3$ or MgO by limiting the total Mg wt % to at least 0.0005%. However, if Mg is added in an amount exceeding the total Mg wt % of 0.0300%, the Mg carbides and Mg sulfides are formed and the formation of such compounds is not desirable from the aspects of the materials. Therefore, the Mg content is limited to 0.0005 to 0.0300%. By the way, the term "total Mg content" represents the sum of the soluble Mg content in the steel, the Mg content that forms the oxides, and other Mg compounds that are unavoidably formed.

Furthermore, in addition to the above, 0.35 to 1.70% of Si is added in claim 1 of the present invention, and 0.05 to 1.70% of Si and 0.30 to 1.20% of Mo are added in claim 3.

Silicon is added for the purpose of deoxidizing and extending the life of the final products by inhibiting the formation of the white structure and the carbide structure and by preventing hardness reduction in the process of rolling fatigue. However, the effects become insufficient when the Si content is less than 0.35% in sole addition thereof. On the other hand, when the content exceeds 1.70%, such effects are saturated, and the toughness of the final products is rather deteriorated. Accordingly, the Si content is defined to be from 0.35 to 1.70%.

Next, Mo is added to improve life of the final products by inhibiting the formation of the white structure and the carbide structure in the rolling fatigue process. When, in a case of complex addition of Si and Mo, the Si and Mo contents are less than 0.05% and less than 0.30, respectively, however, the effects are not sufficient and when Si and Mo exceed 1.70% and 1.2%, respectively, on the other hand, the effects are saturated and rather invite the deterioration of the toughness of the final product. Therefore, the Si and Mo contents are limited to 0.05 to 1.70% and 0.30 to 1.20, respectively.

P: not more than 0.025%

Phosphorus causes grain boundary segregation and center-line segregation in the steel and results in the deterioration of the strength of the final products. Particularly when the P content exceeds 0.025%, the deterioration of the strength becomes remarkable. Therefore, 0.025% is set as the upper limit of P.

Ti: not more than 0.0050%

Titanium forms a hard precipitation TiN, which triggers the formation of the white structure and the carbide structure. In other words, it functions as the start point of rolling fatigue failure and results in the deterioration of rolling life of the final products. Particularly when the Ti content exceeds 0.0050%, the deterioration of life becomes remarkable. Therefore, 0.0050% is set as the upper limit of Ti.

Total O: not more than 0.0020%

In the present invention, the total O content is the sum of the content of O dissolved in the steel and the content of O forming oxides (mainly alumina) in the steel. However, the total O content approximately agrees with the content of O forming the oxides. Accordingly, when the total O content is higher, the amount of $Al_2O_3$ the steel to be reformed is greater. The limit of the total O content from which the effects of the present invention in the induction-hardened material can be expected has been investigated. As a result, it has been found that when the total O content exceeds 0.0020% by weight, the amount of $Al_2O_3$ becomes excessive and as a result the total amount of $Al_2O_3$ in the steel cannot be converted to $MgO \bullet Al_2O_3$ or MgO to leave alumina in the steel at the time of adding Mg. The total O content in the steel of the present invention must be, therefore, restricted to up to 0.0020% by weight.

Next, the steels according to claims 2 and 4 can contain one or both of Ni, V in order to improve hardenability, to prevent hardness reduction in the rolling fatigue process and to inhibit the formation of the white structure and carbide structure.

Ni: 0.10 to 2.00%

V: 0.03 to 0.7%

Both of these elements improve hardenability, and are effective for preventing repetitive softening by restricting the drop of the dislocation density in the rolling process or by restricting the formation of cementite in the repetitive process. This effect is not sufficient when Ni is less than 0.10% and V is less than 0.03%. On the other hand, when these elements exceed the ranges of Ni: 2.00% and V: 0.7%, the effect is saturated and rather invites the deterioration of the toughness of the final products. Therefore, the contents are limited to the range described above.

Next, the reasons for limiting the number ratio of the oxide inclusions in the steel according to claim 5 will be explained. In the refining process of steels, oxide inclusions outside the range of the present invention, that is, oxide inclusions other than $MgO \bullet Al_2O_3$ and MgO, exist due to an unavoidable mixture. When the amounts of these inclusions are set to less than 20% of the total in terms of the number ratio, fine dispersion of the oxide inclusions can be highly stabilized, and further improvements in the materials can be recognized. Therefore, the number ratio is limited to (number of $MgO \bullet Al_2O_3$+number of MgO)/number of total oxide type inclusions$\geqq$0.8.

By the way, in order to bring the number ratio of the oxide inclusions into the range of the present invention, it is an effective method to prevent mixture of oxides of an external system such as those from refractories, but the present invention does not particularly limit the production condition relating to this requirement.

The production method of the steel according to the present invention is not particularly limited. In other words, melting of a base molten steel may be carried out by a blast furnace-converter method or an electric furnace method. The method of adding the components to the mother molten steel is not particularly limited, either, and a metal containing each component to be added or its alloy may be added to the mother molten steel. The method of addition, too, may be an addition method utilizing natural dropping, a blowing method using an inert gas, a method which supplies an iron wire, into which an Mg source is filled, into the molten steel, and so forth. Further, the method of producing a steel ingot from the mother molten steel and rolling the steel ingot is not particularly limited, either.

Though the present invention is directed to the steel for bearing parts produced by the carburizing-quenching process, the carburizing and quenching conditions, the existence of tempering, the tempering condition when it is conducted are not particularly limited.

EXAMPLES

Hereinafter, the effects of the present invention will be represented more concretely with reference to Examples.

Steel blooms each having the chemical compositions tabulated in Tables 1 and 2 were produced by a blast furnace-converter-continuous casting method. Mg was added by a method which supplied an iron wire packed with a mixture of metallic Mg particles and Fe-Si alloy particles into the molten steel, inside a ladle, discharged from the converter.

Next, round bars having a diameter of 65 mmϕ were produced by bloom rolling and bar rolling. The number ratio of oxides in the section of the steel materials in the rolling direction and the size ratios of the oxides were measured. As a result, all the steels according to the present invention fell within the suitable range as tabulated in Tables 3 and 4. A testpiece for the rolling fatigue test was collected and prepared from each steel material of the present invention and was then carburization treated in the steps of 930° C.×300 min→830° C.×30 min→130° C. oil quenching→160° C.×60 min tempering.

TABLE 1

| | | Chemical composition of test steel (wt %) | | | | | | | | | | | | | | |
|---|---|---|---|---|---|---|---|---|---|---|---|---|---|---|---|---|
| Clas. | No. | C | Si | Mn | S | Cr | Al | N | T.Mg | P | Ti | T.O | Ni | V | Mo | Note |
| Steel of invention | 1 | 0.20 | 0.38 | 0.80 | 0.005 | 0.97 | 0.024 | 0.009 | 0.0032 | 0.009 | 0.0007 | 0.0007 | — | — | — | |
| | 2 | 0.21 | 1.01 | 0.75 | 0.003 | 0.95 | 0.031 | 0.012 | 0.0025 | 0.011 | 0.0007 | 0.0007 | — | — | — | |
| | 3 | 0.20 | 1.49 | 0.69 | 0.008 | 1.12 | 0.026 | 0.006 | 0.0069 | 0.010 | 0.0009 | 0.0008 | — | — | — | |
| | 4 | 0.18 | 0.54 | 1.52 | 0.004 | 0.51 | 0.025 | 0.012 | 0.0030 | 0.015 | 0.0008 | 0.0007 | — | — | — | |
| | 5 | 0.25 | 0.92 | 0.78 | 0.006 | 1.03 | 0.026 | 0.008 | 0.0011 | 0.009 | 0.0007 | 0.0007 | 1.20 | — | — | |
| | 6 | 0.21 | 1.04 | 0.78 | 0.008 | 1.02 | 0.024 | 0.006 | 0.0031 | 0.014 | 0.0014 | 0.0006 | — | 0.15 | — | |
| | 7 | 0.21 | 0.63 | 0.80 | 0.005 | 1.05 | 0.030 | 0.004 | 0.0093 | 0.016 | 0.0006 | 0.0006 | 0.43 | 0.10 | — | |
| | 8 | 0.19 | 0.50 | 0.77 | 0.008 | 0.98 | 0.025 | 0.005 | 0.0025 | 0.015 | 0.0006 | 0.0006 | — | — | 0.54 | |
| | 9 | 0.20 | 0.98 | 0.78 | 0.006 | 0.98 | 0.029 | 0.009 | 0.0038 | 0.015 | 0.0007 | 0.0007 | — | — | 0.48 | |
| | 10 | 0.22 | 0.22 | 0.78 | 0.007 | 0.99 | 0.026 | 0.008 | 0.0146 | 0.017 | 0.0006 | 0.0006 | — | — | 0.34 | |
| | 11 | 0.22 | 1.41 | 0.81 | 0.005 | 1.04 | 0.020 | 0.012 | 0.0032 | 0.012 | 0.0005 | 0.0005 | — | — | 0.53 | |
| | 12 | 0.20 | 0.37 | 0.67 | 0.003 | 0.91 | 0.032 | 0.006 | 0.0058 | 0.009 | 0.0007 | 0.0007 | — | — | 1.03 | |
| | 13 | 0.20 | 0.25 | 1.48 | 0.006 | 0.46 | 0.019 | 0.007 | 0.0028 | 0.013 | 0.0008 | 0.0006 | — | — | 0.36 | |
| | 14 | 0.21 | 0.48 | 0.78 | 0.005 | 1.07 | 0.027 | 0.007 | 0.0018 | 0.016 | 0.0007 | 0.0008 | 0.89 | — | 0.48 | |
| | 15 | 0.19 | 0.89 | 0.80 | 0.007 | 0.98 | 0.023 | 0.006 | 0.0028 | 0.014 | 0.0009 | 0.0007 | — | 0.17 | 0.51 | |
| | 16 | 0.20 | 0.67 | 0.80 | 0.006 | 1.15 | 0.031 | 0.008 | 0.0057 | 0.016 | 0.0008 | 0.0007 | 0.56 | 0.08 | 0.38 | |
| | 17 | 0.19 | 0.56 | 0.80 | 0.005 | 1.03 | 0.031 | 0.009 | 0.0015 | 0.017 | 0.0015 | 0.0006 | — | — | — | |
| | 18 | 0.13 | 0.40 | 0.67 | 0.003 | 1.41 | 0.026 | 0.008 | 0.0023 | 0.012 | 0.0014 | 0.0007 | — | — | — | |
| | 19 | 0.32 | 0.38 | 0.90 | 0.006 | 0.93 | 0.025 | 0.012 | 0.0018 | 0.009 | 0.0016 | 0.0006 | — | — | — | |
| | 20 | 0.20 | 1.54 | 1.71 | 0.005 | 0.43 | 0.026 | 0.007 | 0.0231 | 0.013 | 0.0015 | 0.0005 | — | — | — | |
| | 21 | 0.22 | 1.42 | 0.72 | 0.007 | 1.36 | 0.024 | 0.008 | 0.0008 | 0.016 | 0.0014 | 0.0007 | — | — | — | |

TABLE 2

(continued from Table 1)

| Clas. | No. | Chemical composition of test steel (wt %) | | | | | | | | | | | | | | |
|---|---|---|---|---|---|---|---|---|---|---|---|---|---|---|---|---|
| | | C | Si | Mn | S | Cr | Al | N | T.Mg | P | Ti | T.O | Ni | V | Mo | Note |
| Steel of invention | 22 | 0.14 | 0.40 | 0.88 | 0.006 | 0.82 | 0.030 | 0.011 | 0.0016 | 0.014 | 0.0016 | 0.0008 | 0.16 | — | — | |
| | 23 | 0.31 | 0.73 | 0.68 | 0.005 | 0.98 | 0.025 | 0.007 | 0.0019 | 0.015 | 0.0014 | 0.0007 | 1.69 | — | — | |
| | 24 | 0.20 | 1.51 | 1.60 | 0.003 | 0.45 | 0.029 | 0.006 | 0.0020 | 0.012 | 0.0013 | 0.0007 | — | 0.30 | — | |
| | 25 | 0.19 | 0.39 | 0.82 | 0.008 | 1.12 | 0.026 | 0.008 | 0.0017 | 0.009 | 0.0015 | 0.0009 | 0.28 | 0.07 | — | |
| | 26 | 0.21 | 0.08 | 0.80 | 0.004 | 1.02 | 0.025 | 0.009 | 0.0023 | 0.013 | 0.0013 | 0.0008 | — | — | 0.42 | |
| | 27 | 0.13 | 0.51 | 0.72 | 0.006 | 0.52 | 0.032 | 0.012 | 0.0008 | 0.016 | 0.0015 | 0.0009 | — | — | 1.05 | |
| | 28 | 0.32 | 1.39 | 1.47 | 0.007 | 0.48 | 0.028 | 0.006 | 0.0224 | 0.014 | 0.0014 | 0.0014 | — | — | 0.34 | |
| | 29 | 0.13 | 0.42 | 0.78 | 0.005 | 0.98 | 0.024 | 0.012 | 0.0017 | 0.015 | 0.0016 | 0.0009 | 1.21 | — | 0.32 | |
| | 30 | 0.28 | 0.08 | 0.79 | 0.008 | 1.03 | 0.031 | 0.008 | 0.0021 | 0.012 | 0.0015 | 0.0008 | — | 0.15 | 0.36 | |
| | 31 | 0.19 | 1.48 | 1.47 | 0.006 | 0.46 | 0.026 | 0.006 | 0.0024 | 0.015 | 0.0014 | 0.0007 | 0.18 | — | 0.68 | |
| | 32 | 0.21 | 0.41 | 0.83 | 0.005 | 0.52 | 0.025 | 0.004 | 0.0016 | 0.009 | 0.0014 | 0.0009 | 0.13 | 0.08 | 0.49 | |
| Comp. steel | 33 | 0.18 | 0.24 | 0.76 | 0.005 | 0.95 | 0.024 | 0.007 | — | 0.012 | 0.0009 | 0.0006 | — | — | — | Note) |
| | 34 | 0.19 | 0.48 | 0.77 | 0.006 | 1.11 | 0.031 | 0.008 | 0.0003 | 0.015 | 0.0007 | 0.0007 | — | — | — | Mg ≦ lower limit |
| | 35 | 0.20 | 0.50 | 0.76 | 0.006 | 0.94 | 0.026 | 0.006 | 0.0362 | 0.009 | 0.0008 | 0.0006 | — | — | — | Mg ≧ upper limit |
| | 36 | 0.20 | 0.20 | 0.81 | 0.007 | 1.02 | 0.024 | 0.007 | 0.0033 | 0.012 | 0.0008 | 0.0006 | — | — | — | Mo less, Si ≦ lower limit |
| | 37 | 0.19 | 0.17 | 0.78 | 0.006 | 0.98 | 0.026 | 0.006 | 0.0030 | 0.010 | 0.0007 | 0.0907 | — | — | 0.16 | Mo ≦ lower limit |

Note)
No. 33 is an example of JIS G 4104, SCr420 steel.

TABLE 3

| Cla. | No. | Oxides | | Mori's thrust type contact rolling fatigue test | | Point contact type rolling fatigue test | | Note |
|---|---|---|---|---|---|---|---|---|
| | | size (μm) | number ratio | $L_{10}$ | Presence of white/carbide structure | $L_{10}$ | Presence of white/carbide structure | |
| Steel of invention | 1 | 2–7 | 0.76 | 7.4 | no | 9.1 | no | First aspect of invention |
| | 2 | 2–7 | 0.73 | 9.6 | no | 12.4 | no | " |
| | 3 | 3–7 | 0.85 | 9.8 | no | 12.9 | no | Fifth aspect of invention |
| | 4 | 2–7 | 0.76 | 8.0 | no | 9.7 | no | First aspect of invention |
| | 5 | 2–7 | 0.71 | 9.2 | no | 12.1 | no | Second aspect of invention |
| | 6 | 3–7 | 0.76 | 9.7 | no | 12.5 | no | " |
| | 7 | 3–8 | 0.86 | 8.4 | no | 11.2 | no | Fifth aspect of invention |
| | 8 | 3–7 | 0.73 | 10.2 | no | 12.5 | no | Third aspect of invention |
| | 9 | 2–7 | 0.78 | 10.3 | no | 12.7 | no | " |
| | 10 | 2–7 | 0.89 | 9.1 | no | 10.9 | no | Fifth aspect of invention |
| | 11 | 2–7 | 0.76 | 9.8 | no | 12.2 | no | Third aspect of invention |
| | 12 | 3–7 | 0.82 | 10.9 | no | 13.4 | no | Fifth aspect of invention |
| | 13 | 2–7 | 0.76 | 8.9 | no | 10.6 | no | Third aspect of invention |
| | 14 | 2–7 | 0.73 | 9.6 | no | 12.5 | no | Fourth aspect of invention |
| | 15 | 3–8 | 0.75 | 10.3 | no | 12.4 | no | Fourth aspect of invention |
| | 16 | 3–7 | 0.85 | 9.5 | no | 11.4 | no | Fifth aspect of invention |
| | 17 | 3–7 | 0.76 | 7.8 | no | 8.8 | no | First aspect of invention |
| | 18 | 3–7 | 0.84 | 8.1 | no | 10.7 | no | Fifth aspect of invention |
| | 19 | 2–7 | 0.78 | 7.4 | no | 8.6 | no | First aspect of invention |
| | 20 | 3–7 | 0.93 | 9.8 | no | 11.7 | no | Fifth aspect of invention |
| | 21 | 3–8 | 0.71 | 9.2 | no | 10.8 | no | First aspect of invention |

Note)
1. The size of oxides designates equivalent spherical diameter present per $mm^2$ of an area.
2. The number ratio of oxides: (number of MgO $Al_2O_3$ + number of MgO per 1 $mm^2$)/total number of the entire oxide inclusions, provided that the numbers are based on $mm^2$.
3. $L_{10}$: relative value on the basis of $L_{10}$ which is defined on be 1 in Comparative Example 33.

TABLE 4

(continued from Table 3)

| Cla. | No. | Oxides size (μm) | Oxides number ratio | Mori's thrust type contact rolling fatigue test $L_{10}$ | Mori's thrust type contact rolling fatigue test Presence of white/carbide structure | Point contact type rolling fatigue test $L_{10}$ | Point contact type rolling fatigue test Presence of white/carbide structure | Note |
|---|---|---|---|---|---|---|---|---|
| Steel of invention | 22 | 3–7 | 0.75 | 8.0 | no | 10.0 | no | Second aspect of invention |
| | 23 | 2–7 | 0.78 | 8.7 | no | 10.7 | no | " |
| | 24 | 2–7 | 0.82 | 9.6 | no | 11.3 | no | Fifth aspect of invention |
| | 25 | 3–7 | 0.77 | 8.5 | no | 10.6 | no | Second aspect of invention |
| | 26 | 2–7 | 0.79 | 8.2 | no | 10.5 | no | Third aspect of invention |
| | 27 | 3–8 | 0.72 | 9.3 | no | 11.2 | no | " |
| | 28 | 2–7 | 0.92 | 10.2 | no | 12.1 | no | Fifth aspect of invention |
| | 29 | 3–7 | 0.76 | 9.4 | no | 10.8 | no | Fourth aspect of invention |
| | 30 | 2–7 | 0.79 | 8.2 | no | 10.4 | no | " |
| | 31 | 2–7 | 0.84 | 10.4 | no | 12.0 | no | Fifth aspect of invention |
| | 32 | 3–7 | 0.75 | 9.3 | no | 10.7 | no | Fourth aspect of invention |
| Comp. steel | 33 | 5–20 | 0 | 1 | yes | 1 | yes | |
| | 34 | 5–14 | 0.44 | 3.9 | yes | 4.2 | yes | |
| | 35 | 4–14 | 0.92 | 4.3 | yes | 4.7 | no | |
| | 36 | 2–7 | 0.75 | 5.5 | yes | 4.0 | yes | |
| | 37 | 2–8 | 0.76 | 6.2 | yes | 5.8 | yes | |

Note)
1. The size of oxides designates equivalent spherical diameter present per $mm^2$ of an area.
2. The number ratio of oxides: (number of MgO $Al_2O_3$ + number of MgO per 1 $mm^2$)/total number of the entire oxide inclusions, provided that the numbers are based on $mm^2$.
3. $L_{10}$: relative value on the basis of $L_{10}$ which is defined on be 1 in Comparative Example 33.

Rolling fatigue life was evaluated by using a Mori thrust-type contact rolling fatigue tester (Herzian maximum contact stress of 540 kgf/$mm^2$) and a point contact type rolling fatigue tester (Herzian maximum contact stress of 600 kgf/$mm^2$) using cylindrical rolling fatigue testpieces. As the scale of fatigue life, "the number of repetitions of stress till fatigue failure at a cumulative destruction probability of 10% obtained by plotting test results on a Weibull chart" is generally used as $L_{10}$ life. In Tables 3 and 4, a relative value of this $L_{10}$ life of each steel material, when $L_{10}$ life of Comparative Example No. 33 was set to 1, was also shown. Further, the existence of the white structure and the carbide structure was examined in each testpiece after rolling fatigue of $10^8$ times, and the result was also shown in Tables 3 and 4.

As shown in Tables 3 and 4, all of the steels according to the present invention are prevented from producing white and carbide structures. Therefore, the steels of the present invention had excellent fatigue characteristics which were about 7 to 11 times better in a Mori thrust type contact rolling fatigue test and about 9 to 14 times better in a point contact type rolling fatigue test than the Comparative steels.

Specifically, the example of the fifth aspect of the invention had an excellent rolling life which was 8 times or more better in a Mori thrust type contact rolling fatigue test and about 11 times or more better in a point contact type rolling fatigue test than the Comparative steels.

On the other hand, Comparative Example 34 represents the case where the amount of addition of Mg was smaller than the range of the present invention. Comparative Example 35 represents the case where the amount of addition of Mg was greater than the range of the present invention. Comparative Example 36 represents the case where no Mo is added and the amount of addition of Si was smaller than the range of the present invention. Comparative Example 37 represents the case where the amount of addition of Mo was smaller than the range of the present invention. The rolling fatigue characteristics of all were about 6.5 times worse in both the Mori thrust type contact rolling fatigue test and the point contact type rolling fatigue test in comparison with Comparative Example 33, and the rolling fatigue characteristics were not sufficient.

As described above, the carburizing bearing steel of the present invention can realize the formation of fine oxide inclusions, the inhibition of white structures and carbide structures and the prevention of hardness reduction. As a result, it has become possible to provide a bearing steel which may greatly improve, in bearing parts, the rolling fatigue life under a high load. Accordingly, the effects of the present invention in industry are extremely significant.

We claim:

1. A long-life carburizing bearing steel comprising, in terms of percent by weight:

C: 0.10 to 0.35%,
Si: 0.35 to 1.70%,
Mn: 0.3 to 2.0%,
S: 0.001 to 0.03%,
Cr: 0.4 to 1.50%,
Al: 0.010 to 0.07%,
N: 0.003 to 0.015%,
Total Mg: 0.0005 to 0.0300%; and
P: not more than 0.025%,
Ti: not more than 0.0050%,
Total O: not more than 0.0020%; and
the balance consisting of iron and unavoidable impurities.

2. A long-life carburizing bearing steel comprising, in terms of percent by weight:

C: 0.10 to 0.35%,
Si: 0.35 to 1.70%,
Mn: 0.3 to 2.0%,

S: 0.001 to 0.03%,

Cr: 0.4 to 1.50%,

Al: 0.010 to 0.07%,

N: 0.003 to 0.015%,

Total Mg: 0.0005 to 0.0300%;

at least one of the members consisting of:

Ni: 0.10 to 2.00%,

V: 0.03 to 0.7%; and

P: not more than 0.025%,

Ti: not more than 0.0050%,

Total O: not more than 0.0020%; and the balance consisting of iron and unavoidable impurities.

3. A long-life carburizing bearing steel comprising, in terms of percent by weight:

C: 0.10 to 0.35%,

Si: 0.05 to 1.70%,

Mn: 0.35 to 2.0%,

S: 0.001 to 0.03%,

Cr: 0.4 to 1.50%,

Mo: 0.30 to 1.20%,

Al: 0.010 to 0.07%,

N: 0.003 to 0.015%,

Total Mg: 0.0005 to 0.0300%; and

P: not more than 0.025%,

Ti: not more than 0.0050%,

Total O: not more than 0.0020%; and the balance consisting of iron and unavoidable impurities.

4. A long-life carburizing bearing steel comprising, in terms of percent by weight:

C: 0.10 to 0.35%,

Si: 0.05 to 1.70%,

Mn: 0.3 to 2.0%,

S: 0.001 to 0.03%,

Cr: 0.4 to 1.50%,

Mo: 0.30 to 1.20%,

Al: 0.010 to 0.07%,

N: 0.003 to 0.015%,

Total Mg: 0.0005 to 0.0300%;

at least one of the members consisting of:

Ni: 0.10 to 2.00%,

V: 0.03 to 0.7%; and

P: not more than 0.025%,

Ti: not more than 0.0050%,

Total O: not more than 0.0020%; and the balance consisting of iron and unavoidable impurities.

5. A long-life carburizing bearing steel according to claim 1, wherein oxides contained in said steel satisfy the following formula as a number ratio:

(number of $MgO \bullet Al_2O_3$+number of MgO)/number of total oxide type inclusions$\geqq$0.80.

6. A long-life carburizing bearing steel according to claim 2, wherein oxides contained in said steel satisfy the following formula as a number ratio:

(number of $MgO \bullet Al_2O_3$=number of MgO)/number of total oxide type inclusions$\geqq$0.80.

7. A long-life carburizing bearing steel according to claim 3, wherein oxides contained in said steel satisfy the following formula as a number ratio:

(number of $MgO \bullet Al_2O_3$=number of MgO)/number of total oxide type inclusions$\geqq$0.80.

8. A long-life carburizing bearing steel according to claim 4, wherein oxides contained in said steel satisfy the following formula as a number ratio:

(number of $MgO \bullet Al_2O_3$=number of MgO)/number of total oxide type inclusions$\geqq$0.80.

* * * * *